US008857198B2

(12) United States Patent
Styn et al.

(10) Patent No.: US 8,857,198 B2
(45) Date of Patent: Oct. 14, 2014

(54) ICEMAKER SHUT OFF METHOD FOR PREMATURE HARVEST REDUCTION

(75) Inventors: Christopher Styn, Louisville, KY (US); Martin Scott Mershon, Louisville, KY (US); Lorina June White, Louisville, KY (US); Khalid Jamal Mashal, Louisville, KY (US); John Alexander Gardner, Louisville, KY (US); Joseph Michael Hauser, Louisville, KY (US)

(73) Assignee: General Electric Company, Schenectady, NY (US)

( * ) Notice: Subject to any disclaimer, the term of this patent is extended or adjusted under 35 U.S.C. 154(b) by 173 days.

(21) Appl. No.: 13/492,323

(22) Filed: Jun. 8, 2012

(65) Prior Publication Data

US 2013/0327069 A1 Dec. 12, 2013

(51) Int. Cl.
*F25C 5/06* (2006.01)

(52) U.S. Cl.
USPC ..... 62/71; 62/126

(58) Field of Classification Search
CPC ..... F25C 5/02; F25D 29/00; F25D 2700/00; F25B 2700/00; F25B 2600/23
USPC ..... 62/71, 126, 158, 157
See application file for complete search history.

(56) References Cited

U.S. PATENT DOCUMENTS

| | | | | |
|---|---|---|---|---|
| 4,049,161 | A * | 9/1977 | Kohl | 222/233 |
| 4,872,318 | A | 10/1989 | Klemmensen | |
| 5,129,237 | A * | 7/1992 | Day et al. | 62/73 |
| 5,460,007 | A | 10/1995 | Reed et al. | |
| 5,901,561 | A * | 5/1999 | Allison et al. | 62/126 |
| 6,339,930 | B2 | 1/2002 | Horey | |
| 6,574,974 | B1 | 6/2003 | Herzog et al. | |
| 6,637,217 | B2 | 10/2003 | Kim et al. | |
| 7,284,392 | B2 * | 10/2007 | Anderson et al. | 62/347 |
| 2002/0095944 | A1 * | 7/2002 | Stensrud et al. | 62/352 |
| 2006/0242971 | A1 * | 11/2006 | Cole et al. | 62/66 |
| 2006/0266067 | A1 * | 11/2006 | Anderson et al. | 62/340 |
| 2008/0130203 | A1 * | 6/2008 | Doberstein et al. | 361/601 |

* cited by examiner

*Primary Examiner* — Mohammad M Ali
(74) *Attorney, Agent, or Firm* — Dority & Manning, P.A.

(57) ABSTRACT

A system and method for controlling an icemaker assembly to prevent premature ice harvests is provided. In particular implementations, normal icemaker operations, including ice cube harvesting, can be suspended when an ice cube level in an ice cube storage bin is detected to exceed a predetermined threshold or when a command is received to prevent harvesting. When a command to prevent harvesting is received, communication from an ice cube storage bin sensor can be disconnected, for instance, after a current harvesting cycle is complete. The communication from the ice cube storage bin sensor can be reconnected following a time interval or after receiving a command to re-start the normal operations.

20 Claims, 7 Drawing Sheets

ICEMAKER SHUT OFF METHOD FOR PREMATURE HARVEST REDUCTION

FIELD OF THE INVENTION

The present disclosure relates to an automatic icemaker and more particularly to an improved icemaker control system.

BACKGROUND OF THE INVENTION

A refrigerator can include an icemaker to provide ice cubes to a user. The ice cubes can be produced automatically or without any interaction with a user. Generally, the icemaker is disposed in a compartment in a door of the refrigerator and ice cubes can be can be dispensed through an opening in the door.

Icemakers can initiate a harvest cycle to replenish a diminished ice cube supply when a sensor indicates that an ice cube level has been depleted below a predetermined threshold. The ice cube level sensor can be a feeler arm or other type of sensor. When the sensor indicates that the ice cube level has dropped below the predetermined threshold, the harvest cycle can be initiated. Alternatively, when the sensor indicates that the ice cube level has exceeded a predetermined threshold, the harvest cycle is prevented from initiating until the sensed ice cube level has again dropped below the predetermined threshold.

When a harvest cycle is initiated before ice cubes are fully frozen, a premature harvest occurs. During a premature harvest, hollow or deformed ice cubes can be formed. The malformed ice cubes can overfill the ice cube storage bin causing an inaccurate detection of the ice cube level by the sensor. In addition, a device that dislodges the ice cubes from the ice cube mold, such as a rake, can become jammed during the harvest cycle preventing normal operation.

Conventionally, a temperature sensing device can be used to prevent premature harvest of ice cubes. The temperature sensing device can detect a temperature within the icemaker to determine when ice cubes are fully frozen after a harvest cycle is initiated. However, sensing the ambient temperature within the within the icemaker can be inaccurate because while the air temperature reaches a predetermined threshold the temperature of the water may not be low enough to freeze into ice cubes.

In another conventional approach, a time component can be added to a temperature sensing method in the icemaker to prevent premature harvesting. The temperature within the icemaker can be monitored until it reaches a predetermined temperature. Once the predetermined temperature is reached, a timer can be initiated and a harvesting cycle can begin after a predetermined time interval elapses. This method is also inaccurate due to the inaccuracies in the temperature sensing element. In addition, the rate at which the ice is produced is inconsistent because the time to reach the predetermined temperature is variable.

Thus, a need exists for an improved icemaker control system that reduces the likelihood of the above-mentioned disadvantages. A system and method that can prevent premature ice harvests would be particularly useful.

BRIEF DESCRIPTION OF THE INVENTION

Aspects and advantages of the invention will be set forth in part in the following description, or may be obvious from the description, or may be learned through practice of the invention.

One exemplary aspect of the present disclosure is directed to an ice maker assembly for an appliance. The icemaker assembly can include an ice cube mold configured to form ice cubes, a water valve configured to provide water to the ice cube mold, an ice cube storage bin in communication with the ice cube mold. The ice cube storage bin can be configured to receive ice cubes from the ice cube mold. The icemaker assembly can also include an ice cube storage bin sensor configured to sense an ice cube level in the ice cube storage bin and a controller coupled to the icemaker assembly. The controller can be configured to receive a signal indicative of a forced harvest prevention command and initiate a forced harvest prevention cycle based on the forced harvest prevention command.

In another exemplary aspect of the present disclosure is directed to a method of controlling an icemaker assembly. The method can include initiating a normal harvest cycle after receiving a signal indicative of a normal harvest command, the normal harvest cycle including actuating a water valve to supply water to an ice cube mold, initiating a heater coupled to the ice cube mold to release ice cubes formed in the ice cube mold, and initiating an ice cube dislodging device to dislodge the ice cubes from the ice cube mold into an ice cube storage bin; receiving a signal indicative of a forced harvest prevention command during the normal harvest cycle; and initiating a forced harvest prevention cycle based on the forced harvest prevention command.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
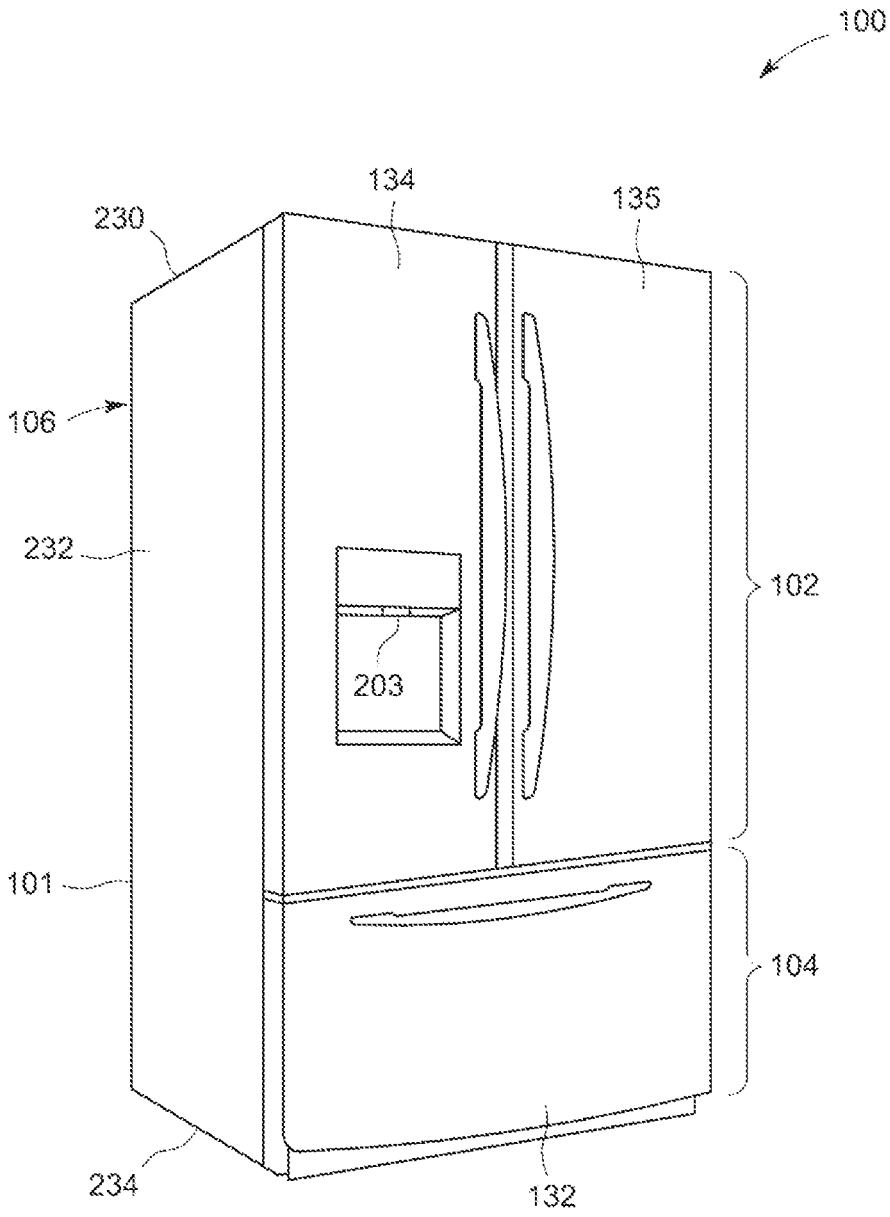
FIG. 1 provides a front view of an exemplary refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to a system and method for controlling an icemaker assembly to prevent premature ice harvests. In particular implementations, normal icemaker operations, including ice cube harvesting, can be suspended when an ice cube level in an ice cube storage bin is detected to exceed a predetermined threshold or when a command is received to prevent harvesting. When a command to prevent harvesting is received, communication from an ice cube storage bin sensor can be disconnected, for instance, after a current harvesting cycle is complete. The communication from the ice cube storage bin sensor can be reconnected following a time interval or after receiving a command to re-start the normal operations.

According to aspects of the present disclosure, an icemaker assembly and method of controlling an icemaker assembly using a forced harvest prevention operation can reduce premature ice harvesting. The size, shape, and rate of production of ice cubes produced by the icemaker assembly can be more consistent because ice cubes can be harvested when they are fully frozen. Damage to the icemaker assembly can be reduced because an ice cube dislodging device, such as a rake, can return to an original position after a harvesting cycle completes.

Figure 2:
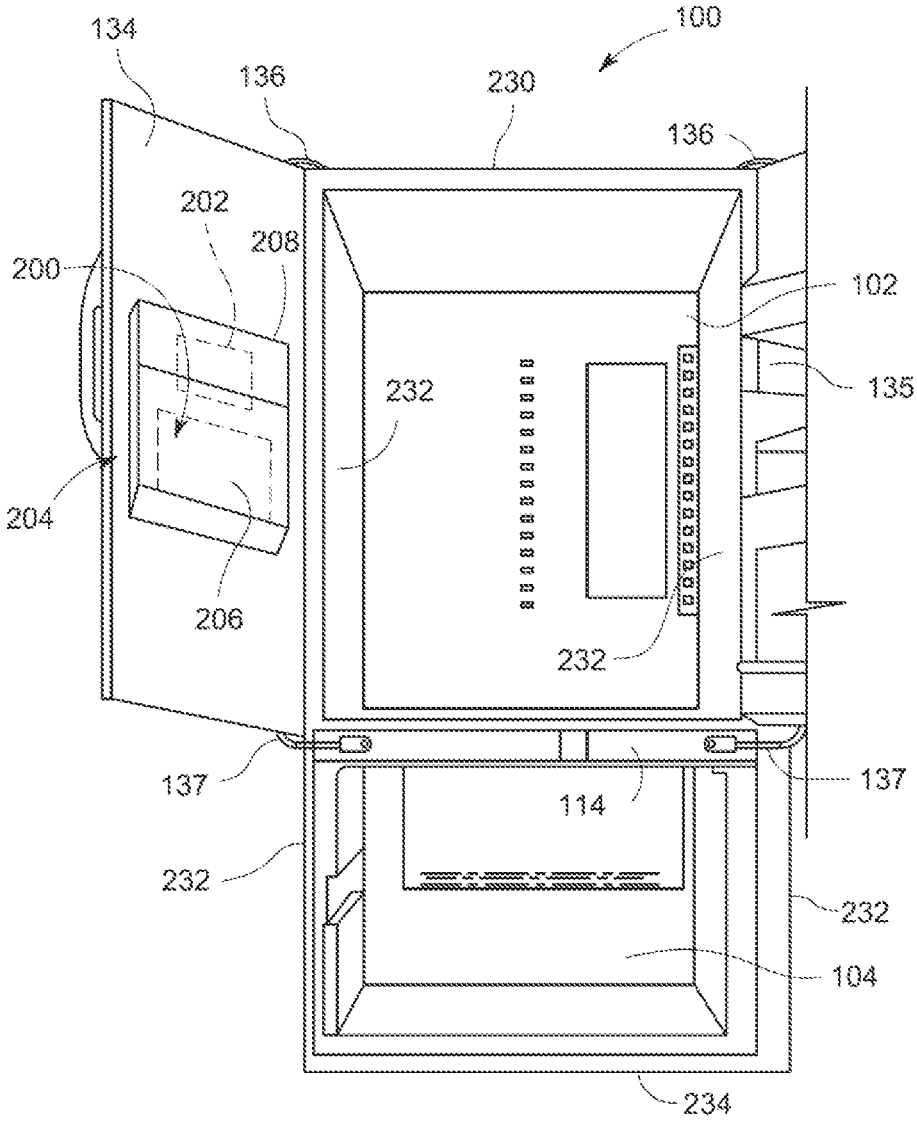
FIG. 2 provides a front view of an interior of an exemplary refrigerator appliance according to an exemplary embodiment of the present disclosure.

FIGS. 1 and 2 illustrate an exemplary refrigerator 100 according to an exemplary embodiment of the present disclosure. Refrigerator 100 can include a fresh food compartment 102, a freezer compartment 104 and an icemaker assembly 200. Although the refrigerator 100 is shown as a "bottom freezer" type, the arrangement of the fresh food compartment, the freezer compartment, and the icemaker assembly are not limited to this type of configuration of a refrigerator. Any appliance having an icemaker assembly, in any configuration or arrangement, intended to be included in the present disclosure.

The fresh food compartment 102 having doors 134, 135, and the freezer compartment 104 having an access door 132 are contained within a main body including an outer case 106 and can be separated by a mullion wall 114. Doors 134, 135 can be French doors mounted to the main body by a top hinge 136 and bottom hinge 137 and access door 132 can provide drawer access to the freezer compartment 104; however any type of door configuration can be used such as a single access door.

Outer case 106 can include a top panel 230 and two sidewall panels 232. The top panel 230 and the sidewall panels 232 can be formed from a single sheet of suitable material or from individual panels. The outer case 106 can also include a bottom panel 234 that connects the two sidewalls 232 and a back panel 101 to each other along a bottom edge of the refrigerator. A thermally insulating liner (not shown) can be disposed between the outer liner and the inner compartments of the fresh food compartment 102 and the freezer compartment 104.

FIG. 2 illustrates an interior view of exemplary refrigerator 100 according to an exemplary embodiment of the present disclosure. An ice making and storage assembly (icemaker) 200 can be mounted on a surface of the access door 134 of the fresh food compartment 102. However, the icemaker 200 can be mounted in any door or on any surface of an appliance.

The icemaker assembly 200 can include a thermally insulated ice compartment 204, an icemaker 202, an ice cube storage bin 206, and an access door 208 which faces the fresh food compartment 102. The thermally insulated ice compartment 204 can be mounted on or formed in the access door 134. Alternatively, the icemaker 202 can be disposed in the freezer compartment 204 and be connected to or in communication with the ice compartment 204 through a channel. Ice cubes can be withdrawn from the icemaker assembly using an ice dispenser (not shown) installed in the access door 134 through opening 203. In addition, access door 208 provides access to the ice cube storage been 206 when door 134 is open.

Figure 3:
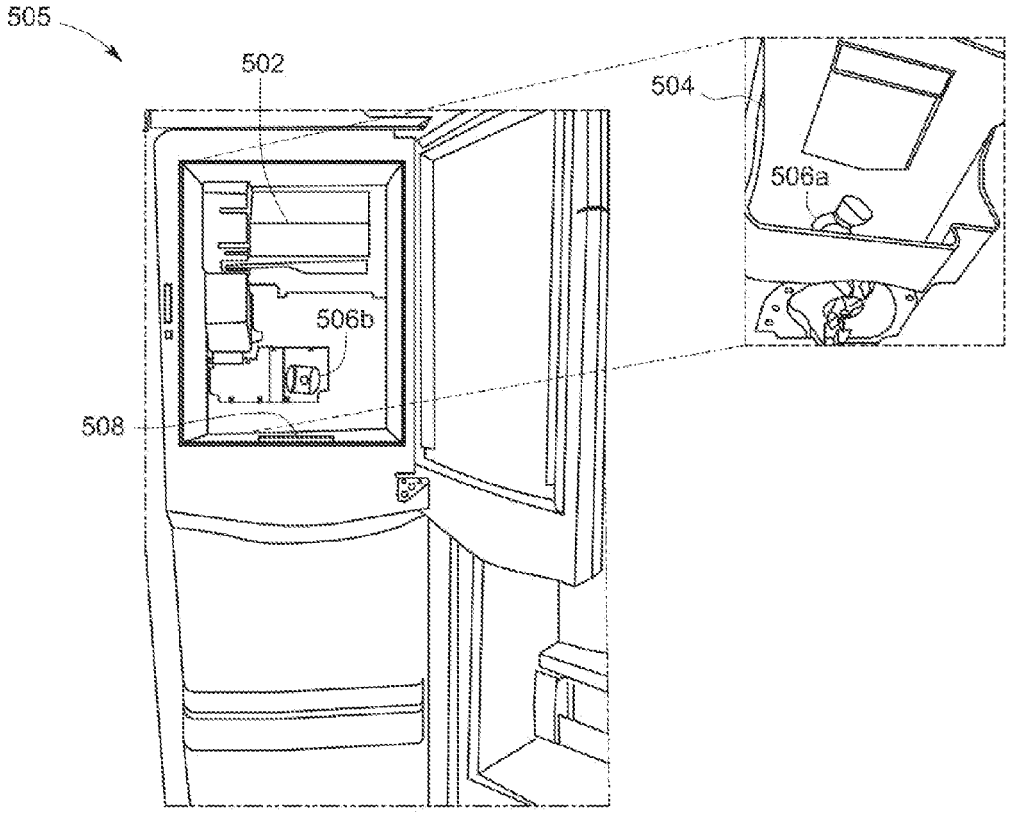
FIG. 3 provides a front view of an exemplary icemaker in a refrigerator appliance according to an exemplary embodiment of the present disclosure.

FIG. 3 illustrates an interior view of an icemaker assembly 200 disposed in ice compartment 505 according to an exemplary embodiment of the present disclosure. During normal icemaker operations, an ice cube harvest cycle can be performed. A normal harvest cycle can include actuating a water value (not shown) to allow water to flow into cavities of an ice cube mold in ice maker 502. A heater can heat the ice cube mold to release the ice cubes from the mold after the ice cubes are formed. A rake or other dislodging device can be used to remove the ice cubes from the mold and into an ice cube storage bin 504. After the harvesting cycle is complete, ice cubes can be dispensed from the icemaker assembly. An ice cube separation device, such as an auger 506*a* can be disposed in the ice cube storage bin 504. Auger 506*a* can be actuated by motor 506*b*, disposed in the ice compartment, to separate ice cubes in bin 504 to dispense ice cubes through ice chute 508.

Figure 4:
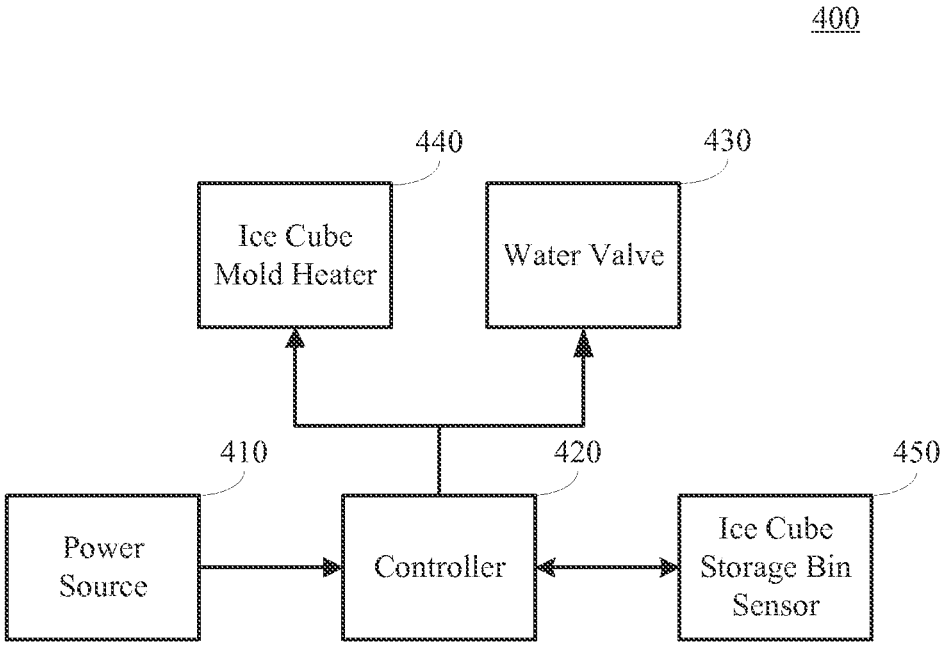
FIG. 4 provides a block diagram of an exemplary icemaker control system according to an exemplary embodiment of the present disclosure.

FIG. 4 illustrates a schematic block diagram 400 of an exemplary control system of icemaker assembly 200 according to an exemplary embodiment of the present disclosure. A power source 410 can provide power to a controller 420. Controller 420 can be coupled with a water valve 430 and an ice cube mold heater 440. The controller 420 can actuate the water valve 430 to provide water to the ice cube mold and provide a signal to the heater 440 to initiate heating. The controller can also be in two-way communication with an ice cube storage bin sensor 450.

Ice cube storage bin sensor 450 can be any type of device that senses an ice cube level in the ice cube storage bin 540. For instance, the ice cube storage bin sensor 450 can be a spring loaded feeler arm in electrical communication with controller 420. For example, the feeler arm can automatically raise and lower as the level of ice cubes in the storage bin 540 varies. When the ice cube level is low, the feeler arm sends a signal to the controller indicative of a low ice cube level. A low ice cube level triggers a normal harvest cycle operation to provide more ice cubes to the ice cube storage bin. When the ice cube level exceeds a predetermined threshold, the feeler arm electrically disconnects from the controller 420 providing a signal indicative of a normal harvest prevention command. After the ice cube level drops below the predetermined threshold, the sensor reconnects electrically with the controller 420 and normal harvest operations continue.

Alternatively, the ice cube storage bin sensor 450 can be any electrical sensing device or circuit. For example, the ice cube storage bin sensor 450 can be a microswitch, an ultrasonic level detector, a piezo sensor, or an optical proximity switch. When the ice cube level exceeds a predetermined threshold, the electrical sensing device sends a normal harvest prevention command to the controller 420 indicative of the exceeded threshold. After sending the command, the electrical sensing device can electrically disconnect from the controller 420 until the level in the ice cube storage bin 540 no longer exceeds the threshold. The electrical sensing device electrically reconnects when the ice cube level drops below the threshold. When the sensor senses a level below the threshold, it generates a signal indicative of resuming a normal harvest cycle.

Controller 420 can be the same controller used by the appliance for all operations or it can be a separate controller. If it is a separate controller, it could be solely for icemaker control or it could also control other sub-appliance controls. The controller 420 can be located within the icemaker assembly 200 or at any other location within the refrigerator appliance 100.

By way of example, any/all of the "controllers" discussed in this disclosure can include a memory and one or more processing devices such as microprocessors, CPUs or the like, such as general or special purpose microprocessors operable to execute programming instructions or micro-control code associated with operation of a refrigerator appliance 100. The memory can represent random access memory such as DRAM, or read only memory such as ROM or FLASH. In one embodiment, the processor executes programming instructions stored in memory. The memory can be a separate component from the processor or can be included onboard within the processor. Alternatively, the controller might also be constructed without using a microprocessor, using a combination of discrete analog and/or digital logic circuitry (such as switches, amplifiers, integrators, comparators, flip-flops, AND gates, and the like) to perform control functionality instead of relying upon software.

According to particular aspects of the present disclosure, a forced harvest prevention signal can also be communicated to the controller 420. For the purposes of this disclosure, a forced harvest prevention signal can be a signal indicative of harvest prevention exclusive of a detected ice cube level in the ice cube bin. A forced harvest prevention signal can be generated within the controller 420 or it could be generated by a device external to the refrigerator appliance 100. For example, a utility or home energy manager can send a signal to the controller 420 to prevent a harvest cycle based on energy availability, time of the day, time of the year, or other variables. The forced harvest prevention signal can be any type of signal. In one embodiment, the forced harvest prevention signal can be a pulse signal where after the signal is received, there is no signal communicated to the controller until a reconnect command is received. In another embodiment, the forced harvest prevention signal can be a signal that is on for the entire harvest prevention signal, where the reconnect command is the absence of a signal communicated to the controller.

Figure 5:
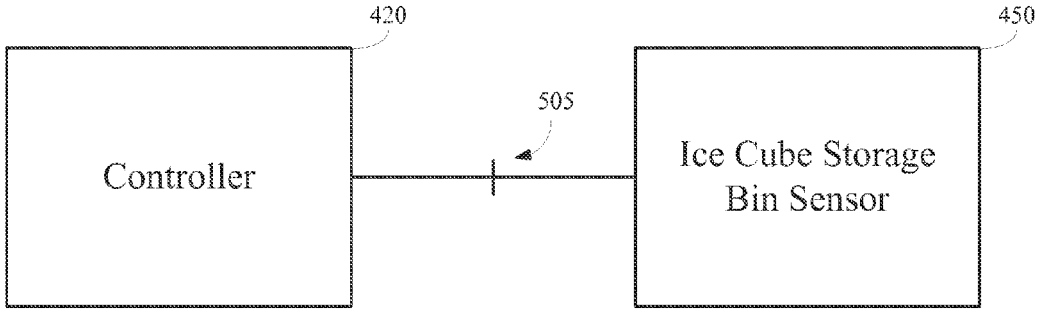
FIGS. 5 and 6 provide an illustration of various states of connection of an exemplary icemaker according to an exemplary embodiment of the present disclosure.

FIG. 5 illustrates an exemplary diagram of a connection state between a controller 420 and an ice cube storage bin sensor 450 according to an exemplary embodiment of the present disclosure. In FIG. 5, the electrical contact 505 is in a closed connection state between the controller 420 and the ice cube storage bin sensor 450 indicative of a state prior to receiving a forced harvest command. The electrical contact 505 can be any device capable of being in selective contact such as a switch or a relay. When the electrical contact 505 is in a closed position, normal harvest operations can proceed.

Figure 6:
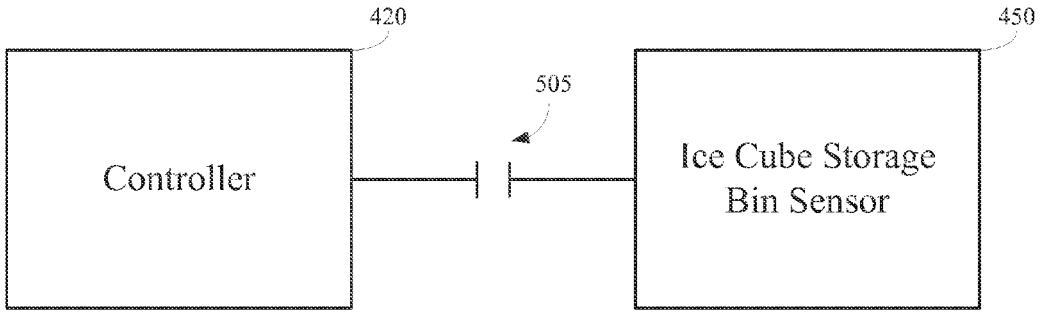

FIG. 6 illustrates an exemplary diagram of a connection state between a controller 420 and an ice cube storage bin sensor 450 according to an exemplary embodiment of the present disclosure. In FIG. 6, a forced harvest prevention cycle can be initiated by the controller 240 actuating the electrical contact 505 to the open position after receiving a forced harvest prevention command. The electrical contact 505 remains in an open position until a signal indicative of an end of the forced harvest prevention cycle is received by the controller 420. When the controller 420 receives the end of forced harvest prevention command, a normal harvest operation can resume by the controller 420 reconnecting the contact 505 to a closed position.

Figure 7:
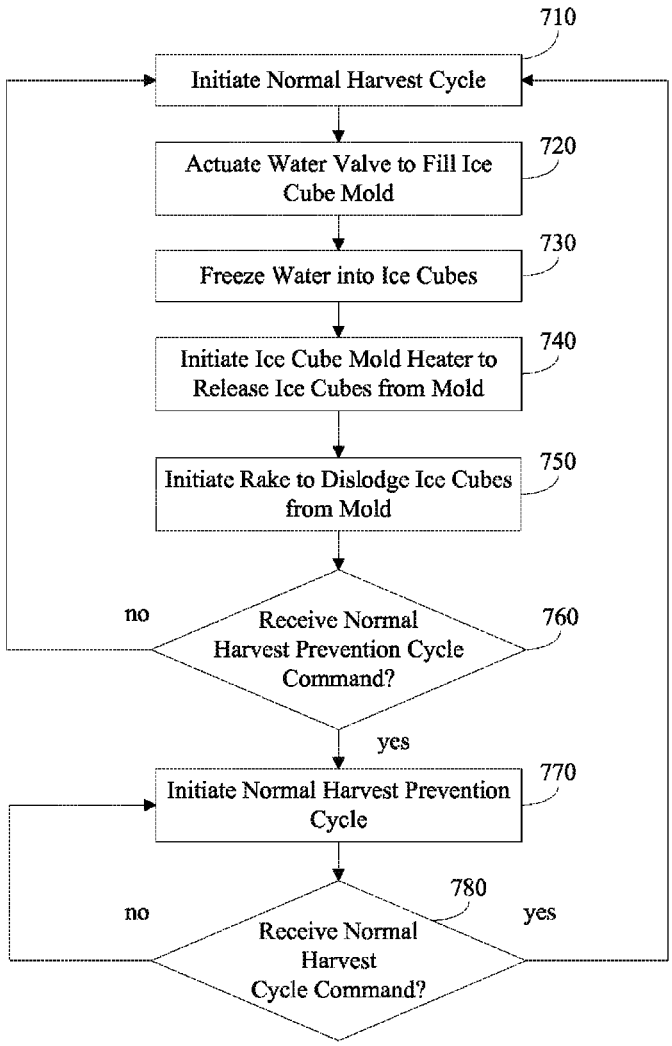
FIG. 7 provides a flow chart of a method of controlling an icemaker according to an exemplary embodiment of the present disclosure.

FIG. 7 illustrates a flow chart of exemplary method 700 according to an exemplary embodiment of the present disclosure. The method 700 can be implemented with any suitable appliance having an icemaker. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

FIG. 7 depicts a flow chart associated with a normal ice harvest cycle. In FIG. 7, a normal harvest cycle can be initiated at (710). A water valve can be actuated to provide water in cavities of an ice cube mold at (720) and ice cubes can be formed by freezing the water at (730). An ice cube mold heater can be initiated to release the ice cubes from the mold at (740) and a rake can be used to dislodge the ice cubes from the mold at (750). The controller can monitor whether a normal harvest prevention cycle command has been received at (760). After a normal harvest prevention cycle command is received, a normal harvest prevention cycle is initiated at (770). To determine whether a normal harvest cycle command has been received, the controller monitors the output of the ice cube storage bin sensor at (780).

During all harvest prevention cycles, normal and forced, no ice cubes are dislodged from the ice cube mold. The ice cube molds can be empty during a harvest prevention cycle or water can be supplied and the ice cube can be formed but they will remain in the mold until after the normal harvest operations begin.

Figure 8:
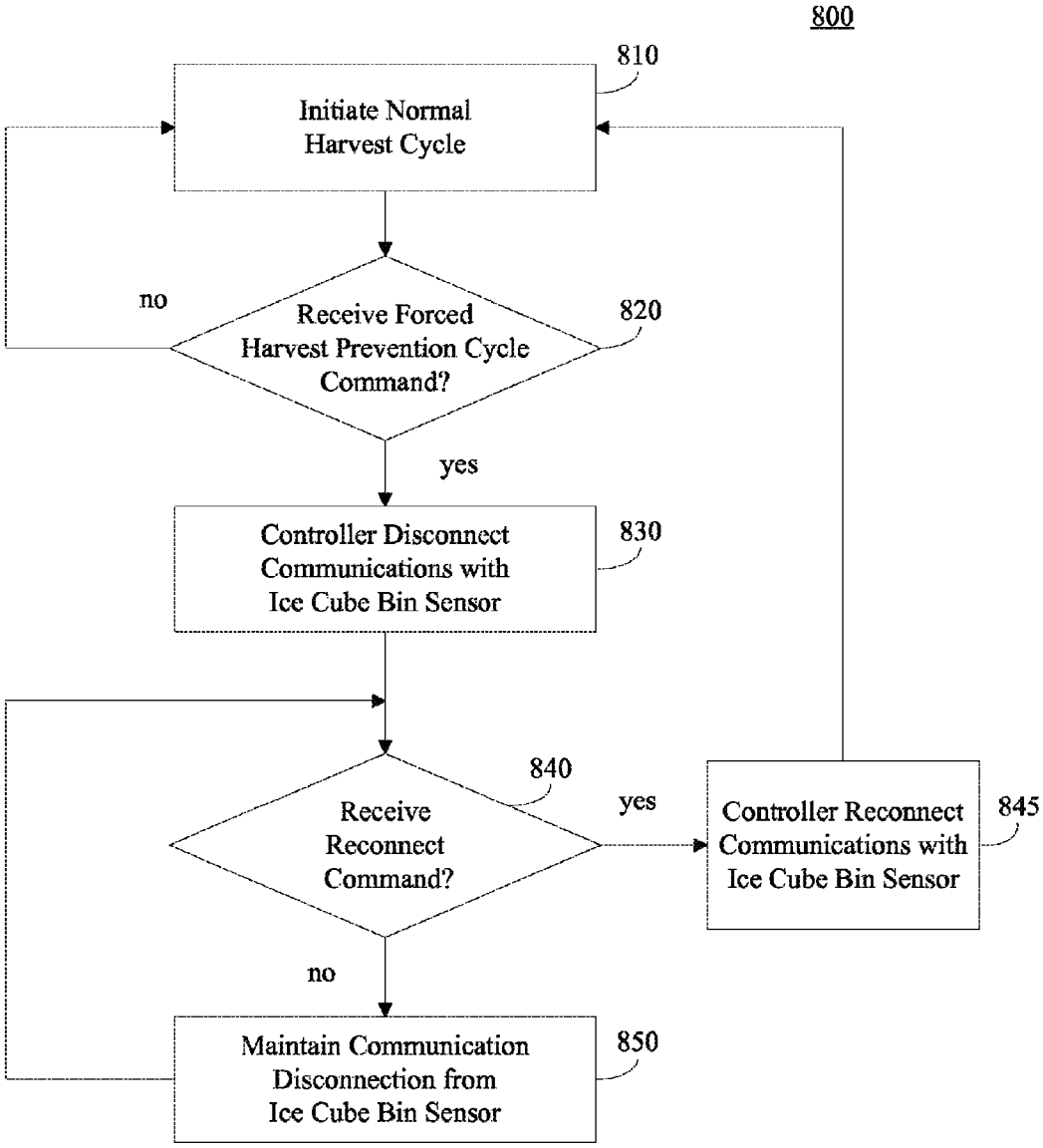
FIG. 8 provides a flow chart of a method of controlling an icemaker according to an exemplary embodiment of the present disclosure.

FIG. 8 illustrates a flow chart of exemplary method 800 according to an exemplary embodiment of the present disclosure. The method 800 can be implemented with any suitable appliance having an icemaker. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

FIG. 8 depicts a forced harvest prevention cycle. In FIG. 8, a normal harvest cycle can be initiated at (810). The controller can monitor to determine whether a forced harvest prevention cycle command has been received at (820). When a forced harvest prevention cycle command has been received, the controller disconnects communications with the ice cube bin sensor at (830) and proceeds to monitor whether a reconnect command has been received at (840). When the forced harvest prevention command is received during a normal harvest cycle, the forced harvest prevention cycle does not begin until after the current normal harvest cycle is completed. For instance, if a forced harvest prevention command is received as the water is filling the ice cube mold or before the rake dislodges the ice cubes from the ice cube mold, the forced harvest prevention cycle will not begin until after all ice cubes are removed from the mold.

The controller can receive a reconnect command after a predetermined time interval has elapsed. Alternatively, the controller can receive a reconnect command from a device external to the icemaker assembly.

The forced harvest prevention cycle has elapsed when a reconnect command is received. The controller reconnects the communications with the ice cube bin sensor at (845) and a normal harvest cycle is initiated at (810). If no further reconnect command is received, communications continue to be disconnected between the controller and the ice cube storage bin sensor.

The system and method for controlling an icemaker assembly, as described above, improves ice cube production and efficiency. Damage to the device can be reduced by preventing premature ice harvests. In addition, consistent size, shape, and rate of production can be achieved by implementing a forced harvest prevention cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker assembly for an appliance, comprising:

an ice cube mold configured to form ice cubes, a water valve configured to provide water to the ice cube mold, an ice cube storage bin in communication with the ice cube mold, the ice cube storage bin configured to receive ice cubes from the ice cube mold, an ice cube storage bin sensor configured to sense an ice cube level in the ice cube storage bin, and a controller coupled to the icemaker assembly, wherein the controller is configured to receive a signal indicative of a harvest cycle command and initiate a harvest cycle in response to the harvest cycle command, the harvest cycle including actuating the water valve to supply water to the ice cube mold and initiating an ice cube dislodging device to dislodge any ice cubes from the ice cube mold into the ice cube storage bin, and wherein the controller is configured to receive a signal indicative of a forced harvest prevention command and initiate a forced harvest prevention cycle based on the forced harvest prevention command, the forced harvest prevention cycle initiated after a current harvest cycle is completed.

2. The appliance as in claim 1, wherein the controller is configured to receive a signal indicative of a normal harvest prevention command and initiate a normal harvest prevention cycle based on the normal harvest prevention command.

3. The appliance as in claim 1, wherein the controller is configured to disconnect communication with the ice cube storage bin sensor to initiate the forced harvest prevention cycle.

4. The appliance as in claim 3, wherein the controller is configured to connect communication with the ice cube storage bin sensor based on a predetermined time interval or a signal indicative of an end of a forced harvest prevention cycle.

5. The appliance as in claim 1, wherein the signal indicative of a normal harvest prevention command is initiated by the ice cube storage bin sensor.

6. The appliance as in 1, wherein the forced harvest prevention command is initiated external to the appliance.

7. The appliance as in claim 1, wherein the forced harvest prevention command is initiated by the controller and is based on a predetermined time interval.

8. The appliance as in claim 1, wherein the ice cube storage bin sensor is a feeler arm.

9. The appliance as in claim 1, wherein the ice cube storage bin sensor is a microswitch, an ultrasonic level detector, a piezo sensor, or an optical proximity switch.

10. The appliance as in claim 1, wherein the signal indicative of the forced harvest prevention command is initiated exclusive of the detected ice cube level in the ice cube bin.

11. A method of controlling an icemaker assembly of an appliance comprising:

initiating a normal harvest cycle after receiving a signal indicative of a normal harvest command, the normal harvest cycle including actuating a water valve to supply water to an ice cube mold, initiating a heater coupled to the ice cube mold to release ice cubes formed in the ice cube mold, and initiating an ice cube dislodging device to dislodge the ice cubes from the ice cube mold into an ice cube storage bin;

receiving a signal indicative of a forced harvest prevention command during the normal harvest cycle; and initiating a forced harvest prevention cycle based on the forced harvest prevention command, wherein initiating the forced harvest prevention cycle based on the forced harvest prevention command is perform after the normal harvest cycle is complete.

12. The method as in claim 11, further comprising:

monitoring an output of an ice cube storage bin sensor for a signal indicative of a normal harvest prevention command; and initiating a normal harvest prevention cycle based on the normal harvest prevention command.

13. The method as in claim 11, wherein the signal indicative of a forced harvest prevention command is initiated by the controller and is based on a predetermined time interval.

14. The method as in claim 11, wherein the signal indicative of a normal harvest prevention command is initiated when ice cubes in the ice cube storage bin exceed a predetermined level.

15. The method as in claim 11, wherein the signal indicative of a forced harvest prevention command is initiated external to the appliance.

16. The method as in claim 11, wherein initiating a forced harvest prevention cycle based on the forced harvest prevention command comprises disconnecting communications from the ice cube storage bin sensor.

17. The method as in claim 16, further comprising connecting communication with the ice cube storage bin when the forced harvest prevention cycle has elapsed.

18. The method as in claim 17, wherein the forced harvest prevention cycle has elapsed when a predetermined time period has elapsed.

19. The method as in claim 17, wherein the forced harvest prevention cycle has ended when a signal indicative of an end of the forced harvest prevention cycle has been received.

20. The method as in claim 11, wherein the signal indicative of the forced harvest prevention command is initiated exclusive of the detected ice cube level in the ice cube bin.

* * * * *